US005941102A

United States Patent [19]

Reinholdsson et al.

[11] Patent Number: 5,941,102

[45] Date of Patent: Aug. 24, 1999

[54] LOCK ASSEMBLY

[76] Inventors: Hans Reinholdsson, Alstigen 12, S-613 40, Oxelösund, Sweden; Karl Stenberg, Prösängsvägen 100, S-613 41, Oxelösund, Sweden

[21] Appl. No.: 09/077,929

[22] PCT Filed: Dec. 3, 1996

[86] PCT No.: PCT/SE96/01590

§ 371 Date: Jul. 23, 1998

§ 102(e) Date: Jul. 23, 1998

[87] PCT Pub. No.: WO97/21896

PCT Pub. Date: Jun. 19, 1997

[30] Foreign Application Priority Data

Dec. 13, 1995 [SE] Sweden ..... 9504455

[51] Int. Cl.[6] ..... E05B 65/48

[52] U.S. Cl. ..... 70/2; 70/33; 70/34; 70/52; 70/131; 70/136; 70/417; 292/281; 292/283; 292/285; 292/340; 292/343

[58] Field of Search ..... 70/2–13, 32–34, 70/52, 54–56, 131, 136, 417; 292/281–286, 340, 342, 343, DIG. 39, DIG. 40, DIG. 55

[56] References Cited

U.S. PATENT DOCUMENTS

| | | | |
|---|---|---|---|
| 915,873 | 3/1909 | Mosher | 292/340 |
| 1,484,830 | 2/1924 | Hurd . | |
| 1,484,831 | 2/1924 | Hurd . | |
| 2,166,660 | 7/1939 | Handshy et al. | 70/9 |
| 3,572,064 | 3/1971 | Berry et al. | 70/52 |
| 3,713,309 | 1/1973 | Miller | 70/52 X |
| 3,817,062 | 6/1974 | Randel | 70/11 |
| 4,011,740 | 3/1977 | Ljungberg | 70/58 |
| 4,026,132 | 5/1977 | Best | 70/34 X |
| 4,103,949 | 8/1978 | Bouloy | 292/342 |
| 4,953,371 | 9/1990 | Appelbaum | 70/32 |

FOREIGN PATENT DOCUMENTS

| | | |
|---|---|---|
| 502887 | 2/1996 | Sweden . |

*Primary Examiner*—Lloyd A. Gall
*Attorney, Agent, or Firm*—Watson Cole Grindle Watson P.L.L.C.

[57] ABSTRACT

Lock assembly including a first locking device in two parts intended to be mounted on a door, and a second detachable locking device intended to be treaded from above on the two parts of the first locking device when the door is closed. One of the locking devices shows a projecting portion and the second locking device shows a recess cooresponding to the projecting portion with a cooresponding wedge-shape. The projecting portion shows an outward directed rim along the sides extending to its wedge-shaped tip, and the recess shows an inwards directed rim along the cooresponding sides. A faucet extends in a locked position through the projecting portion across the recess. The projecting portion shows a half-cylindric cavity and the faucet shows a half-cylindric section and is fit into the bottom of the half-cylindric cavity.

10 Claims, 5 Drawing Sheets

LOCK ASSEMBLY

TECHNICAL FIELD

The present invention concerns a lock assembly including a first locking means in two parts intended to be attached, e.g. screwed vertically with at least one of its two parts on a door, and a detachable second locking means, intended to be brought on the two parts of the first locking means from above when the door is closed, whereby one of the locking means is showing a projecting portion and the second locking means is showing a recess corresponding to the projecting portion, and whereby the projecting portion is intended to be locked in the recess.

BACKGROUND TECHNICS

The locking assembly according to the preamble preferably is intended to be used for locking of a container door, which as a rule is constituted by a double door at one end of the container. A lock assembly for locking of such a door is known from the Swedish patent publication SE 9003139-4, showing a first locking means in two parts, which parts are intended to be screwed on each of the door leaves of the container, and a detachable second locking means intended to be brought into notches in the parts of the first locking means and locked to one of these parts by means of a padlock.

A drawback with the known lock assembly is that the parts of the split first locking means can be brought out of their position at careless treating of the door leaves causing difficulties in entering the detachable second locking means into the notches in the parts of the first locking means. As the notches in the first locking means are mutually parallel a sticking effect also can arise which also makes the treading of the second locking means more difficult. Also the tongues, by which the padlock keeps the first and the second locking means together, is a weakness in the construction that easily can be demolished by outer effects. The known locking device also shows a relatively complex shape which makes its manufacturing more expensive.

DESCRIPTION OF THE INVENTION

The purpose with the present invention is to bring about a lock assembly according to the preamble which is not showing the drawbacks of the known lock assembly mentioned above. The lock assembly according to the invention is including a first looking means in two parts intended to be brought, e.g. screwed vertically with at least one of its two parts on a door, and a detachable second locking means intended to be brought from above on the two parts of the first locking means when the door is closed. One of the locking means is showing a projecting portion and the second locking means is showing a recess corresponding to the projecting portion.

The lock assembly according to the invention is characterized in that the projecting portion and the recess is showing a mutually corresponding wedge-shaped, that the projecting portion is showing an outwardly directed rim, that the recess is showing an inwardly directed rim, and that the first locking means and the second locking means brought together are arranged in that the outwardly directed rim of the projecting portion hooks behind the inwardly directed rim of the recess.

By the projecting portion and wedge-shape of the recess is achieved that the parts of the first locking means in a simple way can be forced in the right position when the second, detachable locking means is attached even if the parts of the first locking means is not in an exact desired mutual position, eventually by influence of relatively big forces directed from above.

Preferably the two parts of the fix first locking means put together is showing a wedge-shaped projecting portion the tip of which is directed upwards, which is provided with an outwardly directed rim along the sides constituting the wedge-shape, and which is divided along a vertical plane extending perpendicular to the plane through the door, whereby the detachable second locking means is showing a corresponding wedge-shaped recess, the tip of which also is directed upwardly, and which at locking of the door is intended to be brought upon the projecting portion of the first locking means two parts from above.

More details and characterizing features concerning the lock assembly according to the invention will be clear from the description to drawings below and from the claims.

BRIEF DESCRIPTION OF DRAWINGS

The invention is described below as an example of an embodiment in connection with the enclosed drawings.

DETAILED DESCRIPTION

Figure 1:
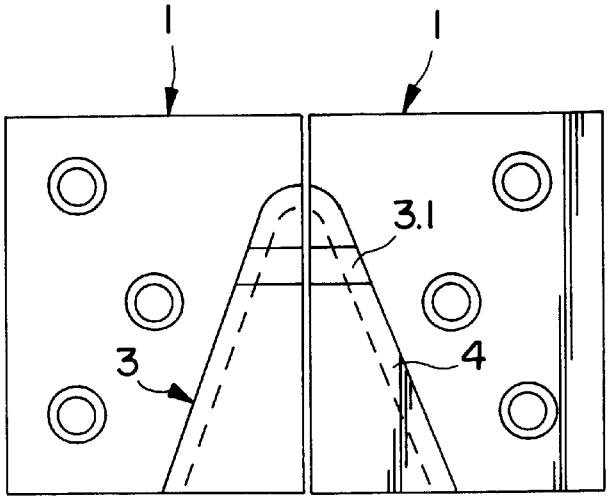
FIG. 1 shows a locking means in two parts to a lock assembly, the parts of which are intended to be screwed to one part each of a double door.
Figure 2:
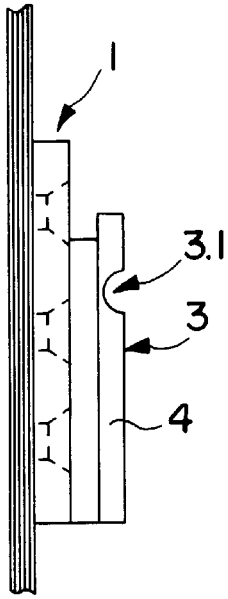
FIG. 2 shows the locking means according to FIG. 1 seen from the left side.

The lock assembly according to FIG. 1–5 includes a male part 1 divided in to two parts intended to be screwed e.g. on each part of a double door, and a detachable female part 2 intended to be brought upon the male parts 1 from above when the door is closed.

The male parts 1 constitutes reflections of each other and show together a wedge-shaped center portion 3 showing a rim 4 projecting along the wedge. A half-cylinder cavity 3.1 runs across the projecting wedge-shaped portion 3 on the assembled male parts 1.

The female parts 2 show a wedge-shaped recess 5, with the same shape as the two assembled male parts 3, which means that the wedge-shaped recess 5 of the female part shows a rim 6 projecting inwardly to the recess and is intended to engage the corresponding rim 4 on the male parts 1. Further the female parts 2 include a cylinder-shaped faucet 7, running across the wedge-shaped recess 5 and to one half fit in into the bottom of the same and showing a half cross section and connected with an ordinary lock cylinder 8.

The lock assembly is closed in that the female part 2 is treaded on the male parts from above, after which the lock cylinder 8 is turned in that way that the faucet 7 is turned so that the portion showing the half section is turned a half turn blocking a lifting of a the female part 2. The lock cylinder 8 is fixed in the female part 2 by screws or pins 9 located on the side facing the male part 1.

The female part 2 in the lock assembly also is provided with at least one safety bar 10, extending parallel to the faucet 7 and freely rotatable along its center axis which prevents that the female part 2 can be cut in pieces.

The lock device according to FIG. 6–10 includes a female part 11 in two pieces intended to be screwed on each part of a double door, and a detachable male part 12, intended to be treaded on the female parts 11 from above when the door is closed.

The female parts 11 constitutes reflections and show together a wedge-shaped recess 13 showing a rim 14 projecting along the recess. The female parts 11 include a cylinder-shaped faucet 17 extending across the wedge-shaped recess 13 with one half fit in into the bottom of the same and showing a half cross section and which is connected to a lock cylinder 18 which is displaceable between an outer position, in which the doors can be opened, and an inner position, in which the door can be locked.

The male part 12 show a wedge-shaped center portion 15 with the same shape as the female parts 13 put together, which means that the wedge-shaped center portion 15 shows a projecting rim 16 intended to engage the corresponding rim 14 on the female parts 11. A half cylinder-shaped groove 15.1 extends across the projecting wedge-shaped portion 15 on the male part 12.

The lock assembly is closed by that the male part 12 is treaded on the female parts 11 from above, after which the lock cylinder 18 is pushed inwards and turned in that way that also the faucet 17 is turned so that its half cylinder portion is turned a half turn and blocking a lifting of the male part 12. The axial displacement of the lock cylinder 18 is limited by screws and pins located in the side facing the male part 12.

Figure 9:
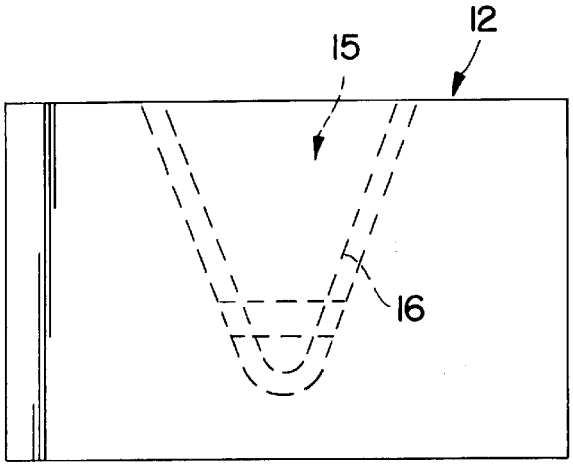
FIG. 9 shows a detachable locking means for connecting the locking means according to FIG. 6.
Figure 10:
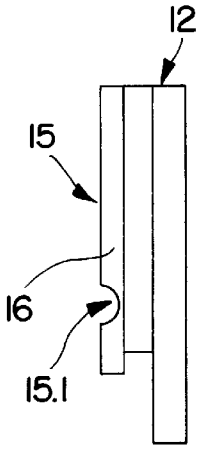
FIG. 10 shows the detachable locking means seen from the left side.

The male part 12 in the lock assembly also can be provided with at least one quenched safety bar, not shown in FIG. 9 or 10, but extending horizontally over the width of the male part 12 and which is freely rotatable along its center axis preventing the male part 12 to be cut in pieces.

The two alternative embodiments described above in connection with FIGS. 1–10 thus are within the scope of the invention.

Figure 3:
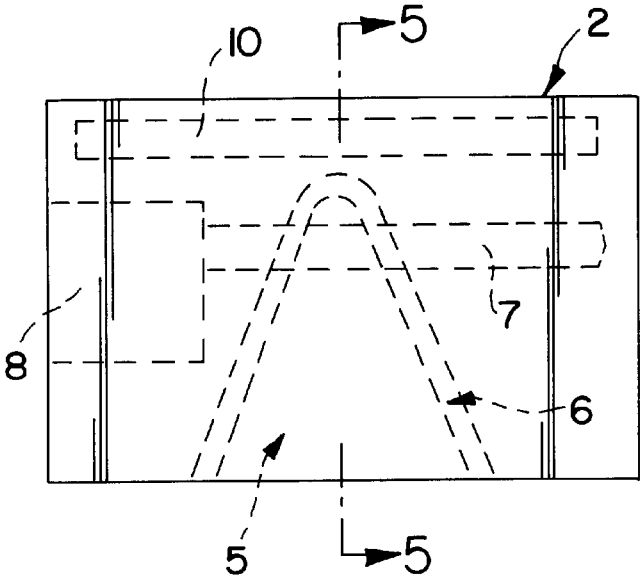
FIG. 3 shows a detachable locking means intended to connect the two parts of the divided locking means according to FIG. 1.
Figure 11:
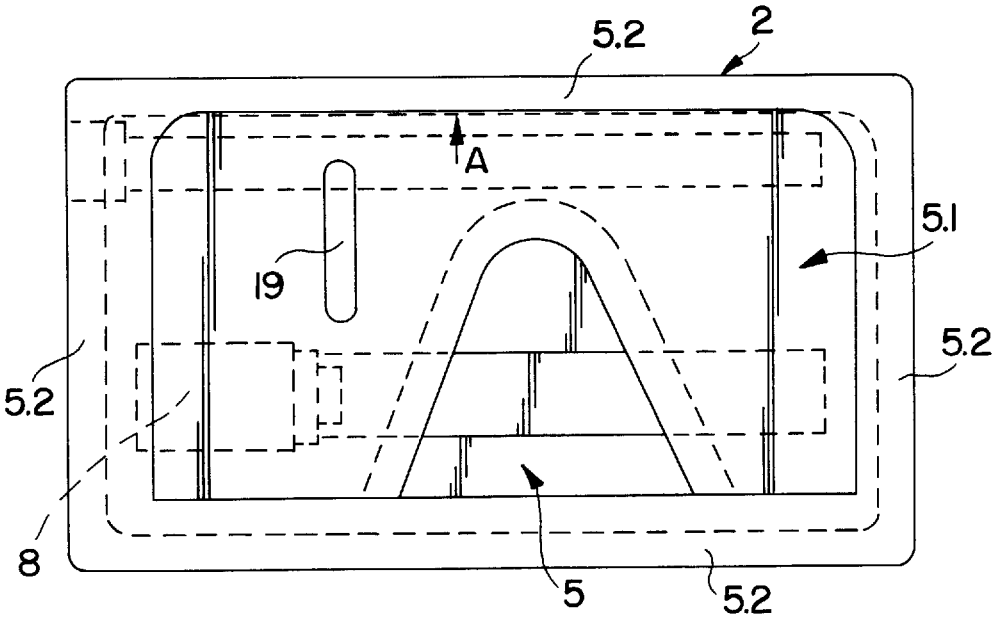
FIG. 11 shows an alternative embodiment of the detachable locking means according to FIG. 3 seen from the side which is facing the fix locking means in an assembled position.
Figure 12:
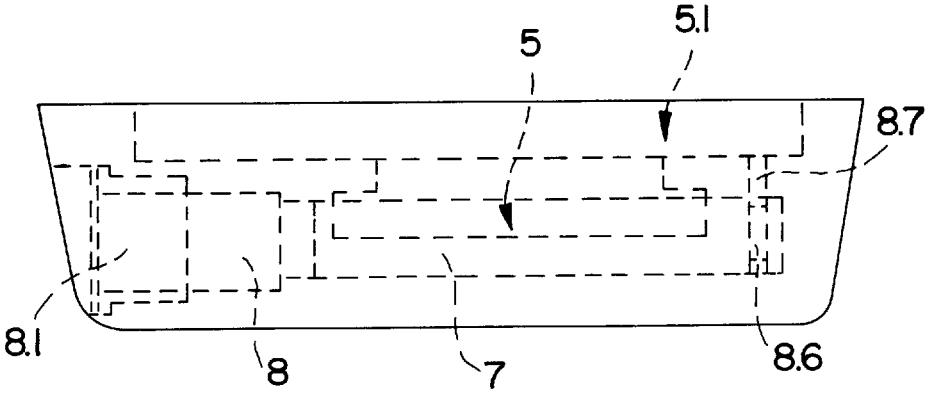
FIG. 12 shows the detachable locking means according to FIG. 11 seen from above.
Figure 13:
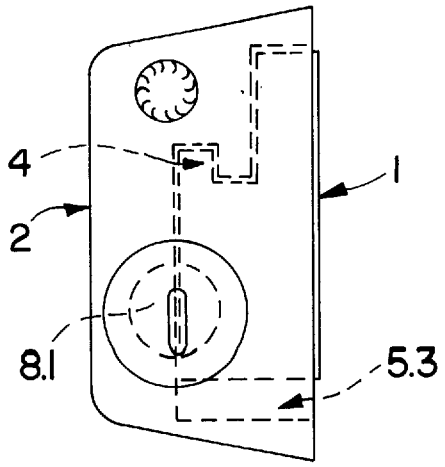
FIG. 13 shows the detachable locking means according to FIG. 11 seen from one side.

The detachable lock assembly shown in FIG. 11 and 12 is constituted by a female part 2 mainly designed in the same way as the female part shown in FIG. 3 with the difference that the recess 5 is arranged in an outer cavity 5.1 surrounded by walls 5.2. The outer cavity 5.1 has a shape and dimension permitting the fix male parts 1 to be fully enclosed in the female part 2 when assembled as shown in FIG. 13. A gap 5.3 thereby is arranged between the lower wall 5.2 and the fix male parts 1 with a width corresponding the width of the rim 4 projecting from the fix wedge-shaped portion 3 of the male parts. In a locked position the detachable female part 2 fully surrounds the fix male parts 1 which reduces the possibilities to break away the female part 2 from the male parts 1 with a tool. In order to make a demolition of the lock assembly more difficult the female part shows a pyramidal shape with sloping sides.

In the embodiment of the female part 2 shown in FIG. 11 a guide groove 19 is provided and intended to enclose a guide pin on one of the male parts 1, not shown in the figure. The guide groove 19 extends in the direction in which the female part 2 is treaded on the male parts 1 permitting the guide pin to move corresponding the vertical move necessary for bringing the female part 2 and the male parts 1 together.

Figure 4:
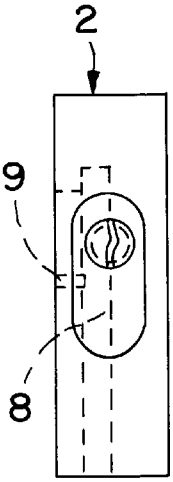
FIG. 4 shows the locking means according to FIG. 3 seen from the left side and with a mounted lock cylinder.
Figure 5:
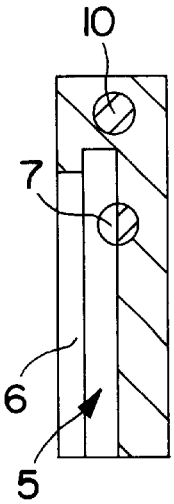
FIG. 5 shows a cross section of the detachable locking means along line 5—5 in FIG. 3.
Figure 6:
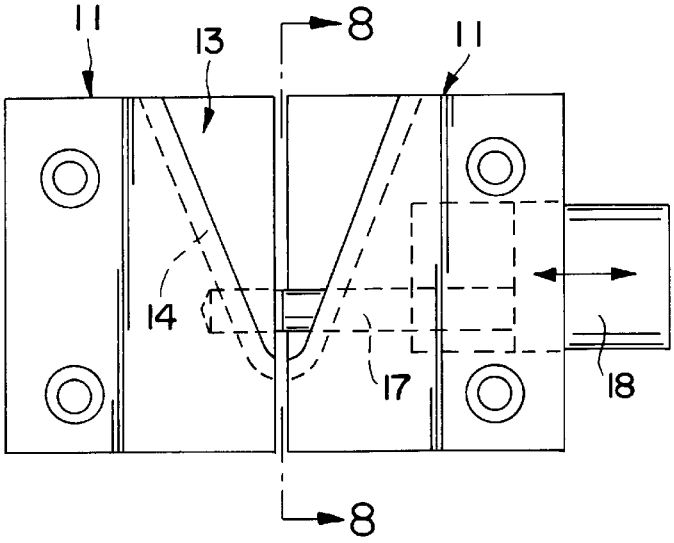
FIG. 6 shows a divided locking means in an alternative embodiment of the invention, the parts of which are intended to be screwed on each part of a double door.
Figure 7:
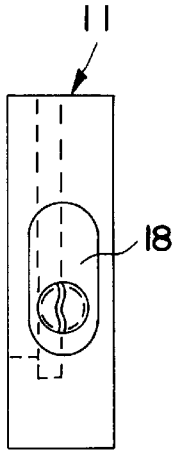
FIG. 7 shows the locking means according to FIG. 6 seen from the right side.
Figure 8:
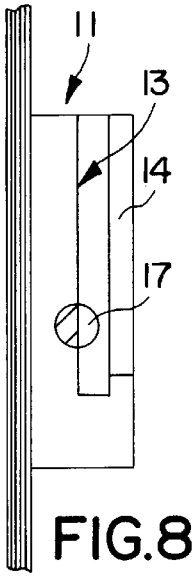
FIG. 8 shows a section between the parts of the locking means along the line 8—8 in FIG. 6.
Figure 14:
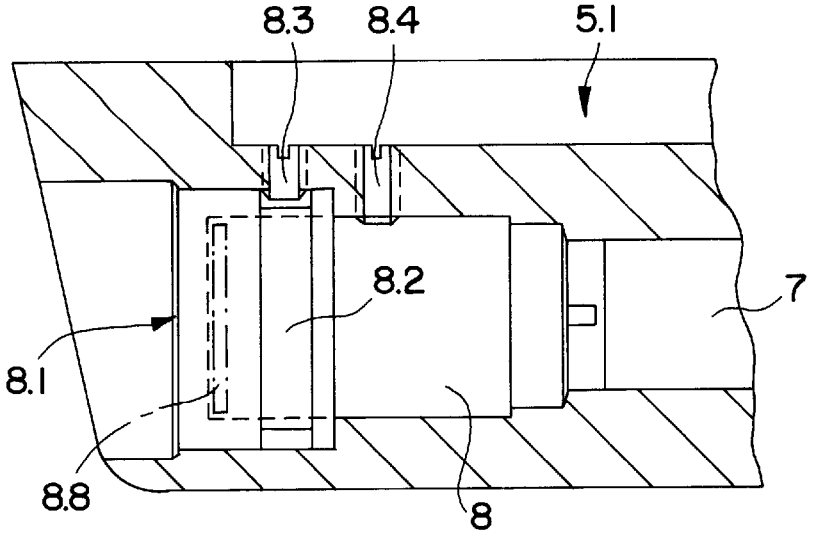
FIG. 14 shows a detail of the detachable locking means according to FIG. 11 seen in a section through the lock cylinder.
Figure 15:
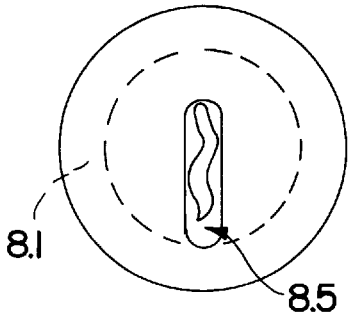
FIG. 15 shows separately a safety cage to the lock cylinder according to FIG. 14 seen in a direction to the key hole in the lock.
Figure 16:
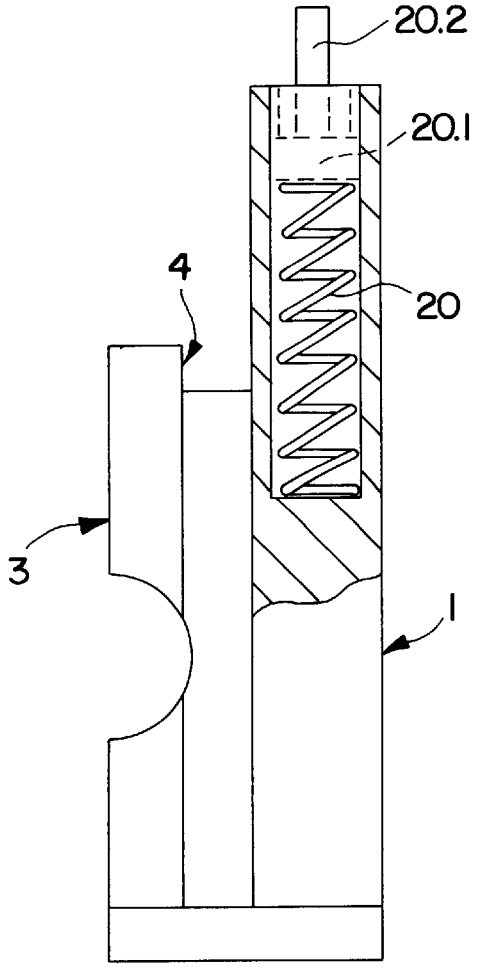
FIG. 16 shows a lifting detail on the fix locking means partly in a section through a spring device.

The female part 2 shown in FIG. 11–13 is provided with a cylindric lock cylinder 8 connected with a faucet 7 of the same design as the one shown in FIGS. 3–5, which is turnable around its center axis. At the key hole the lock cylinder 8 is surrounded by a safety casing 8.1 provided with a flat end wall which is shown in detail in FIG. 14 and 15 and which is manufactured of quenched steel. The safety casing 8.1 shows an outer cylindric groove 8.2 in which a first stop screw 8.3 is brought from a protected position when the parts of the lock are assembled. In FIG. 14 the first stop screw 8.3 is shown brought from the inner side facing the male parts 1. A second stop screw 8.4 for the lock cylinder 8 is brought parallel to the first stop screw 8.3 with the intention to keep the lock cylinder 8 fixed against turning sideways when the lock is opened or closed by turning a belonging key. In FIG. 15 the safety casing 8.1 is seen in a direction to the key hole of the lock cylinder and showing an oblong aperture 8.5 in the end wall. When a key is brought through the aperture 8.5 and into the key hole of the lock cylinder 8 and turned the safety casing will follow the turning as the lock cylinder 8 is kept fixed by means of the second stop screw 8.4. In an attempt to remove the safety casing 8.1 using of a rotating drill the casing will start to rotate without permitting the drill to penetrate into and release the lock cylinder. In order to prevent the faucet 7 to be removed from the end opposite the lock cylinder 8 by drilling also this one can be provided with a groove 8.6 and a third stop screw 8.7 shown by dotted lines in FIG. 12.

In an alternative embodiment of the invention the safety casing 8.1 can be replaced by or completed with a separate safety washer 8.8 which is arranged inside the end wall of the safety casing 8.1, shown dotted in FIG. 14, whereby the safety casing 8.1 shows a circular opening in the end wall as the separate safety washer 8.8 shows an oblong aperture for a key corresponding to the aperture 8.5 shown in FIG. 15. In this alternative embodiment the safety casing can be firmly screwed by means of the first stop screw 8.3 without the groove 8.2 shown in FIG. 14 as the safety washer 8.8 is freely rotatable inside the safety casing 8.1 giving protection against drilling.

In an unlocked position the female part 2 can be lifted from the male parts 1 by means of a lifting spring 20 arranged in at least one of the male parts 1. The lifting spring 20 is arranged in a vertical bore and acting upon a piston 20.1 provided with a projecting lifting pin 20.2. The lifting point on the female part 2 is marked with an arrow A in FIG. 11. In an unlocked position the rim 6 of the wedge-shaped recess 5 in the female part 2 is kept lifted out of engagement from the corresponding rim 4 on the wedge 3 to the male parts 1. By the arrangement of the guide groove 19 in the female part 2 and the corresponding guide pin on one of the male parts 1 the lifting point A for the lifting spring 20 can be arranged at the side of the balance point of the female part 2 without making the female part 2 tilting to the balance point side when lifted by the force of the lifting spring 20. The benefit of the guide groove 19 and the corresponding guide pin is obvious when the lifting spring 20 is placed in one of the male parts 1. In one embodiment of the lock assembly, when the wedge portions 3 on the male parts 1 are arranged in a big distance from each other as well as also when two or more complete wedges 3 are arranged along a line and intended to carry an oblong female part 2 showing the corresponding recesses 5, two or more lifting springs 20 can be arranged along the base plate of the male part. In this embodiment the female part 2 can e.g. constitute a bracket for an outboard-motor to be brought on the counter of a boat by male parts arranged on the same. This use of the lock assembly according to the invention is not shown in the figures.

Figure 17:
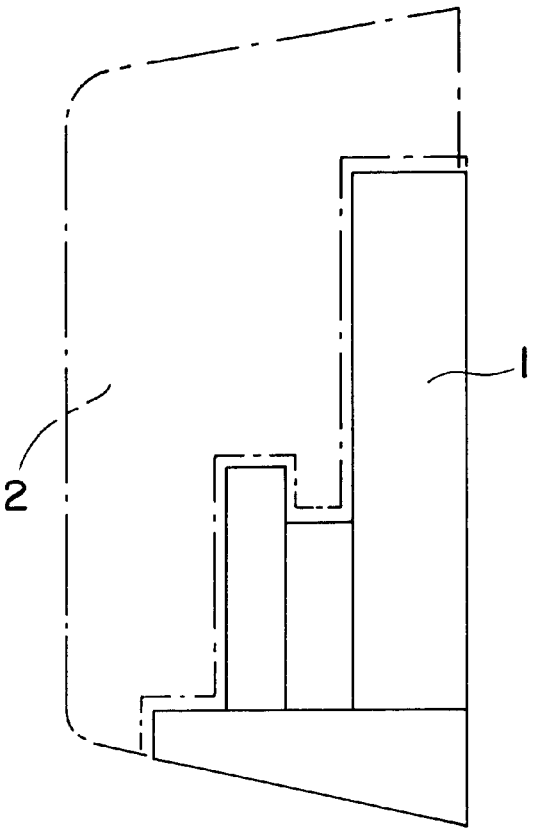
FIG. 17 and 18 shows another alternative embodiment of the detachable locking means seen from the side.
Figure 18:
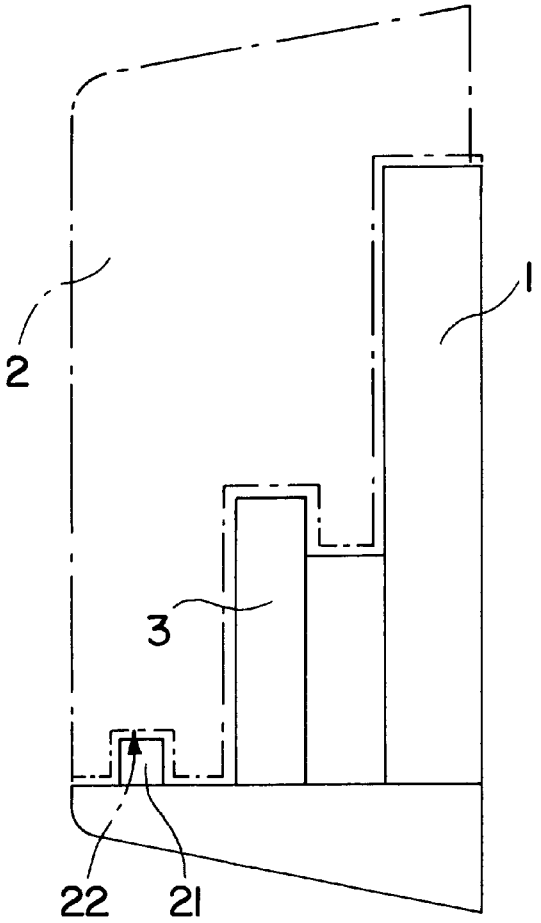

The female part 2 also can be given alternative designs as shown in FIG. 17 and 18, in which figures the male parts 1 are shown in full lines and the female part 2 is dotted. In FIG. 17 the female part 2 is shown connected to the male parts 1 with a gap at the lower side of the assembly. In FIG. 18 the female part 2 is shown connected to the male parts 1 partly by the wedge 3 and the corresponding recess, partly by another stopping rim 21 arranged on a projecting portion of each male part 1 and brought into a corresponding groove 22 in the female part 2.

We claim:

1. Lock assembly including a first locking means (1) in two parts intended to be mounted, e.g. vertically screwed with at least one of its two parts on a door and a detachable second locking means (2) intended to be treaded from above on the two parts of the first locking means (1) when the door is closed, whereby one of the locking means shows a projecting portion (3) and the second locking means shows a recess (5) corresponding to the projecting portion (3), characterized in that the projecting portion (3) and the recess (5) each show to each other a corresponding wedge-shape in a plane parallel to the plane through e.g. said door, that the projecting portion (3) shows an outwards directed rim (4) along the sides extending to its wedge-shaped tip, that the recess (5) shows an inwards directed rim (6) along the sides extending to its wedge-shaped tip, and that a faucet (7) in a locked position extends through the projecting portion (3) respectively across the recess (5) when the first locking means (1) is brought together with the second locking means (2), that the projecting portion (3) shows a half-cylindric cavity (3.1), and that the faucet (7) shows a half-cylindric section fit into the bottom of the half-cylindric cavity (3.1).

2. Lock assembly according to claim 1, characterized in that the faucet (7) is connected with a lock cylinder (8) arranged in the detachable second locking means (2).

3. Lock assembly according to claim 1, characterized in that a cylindric safety bar (10), freely rotatable along its center axis, extends parallel to the faucet (7) in the second locking means (12).

4. Lock assembly according to claim 2, characterized in that the lock cylinder (8) at its outer end is covered by at least one safety means (8.1, 8.9) which is freely rotatable, and that the safety means (8.1, 8.9) shows an aperture (8.5) mainly corresponding to a key hole in the lock cylinder (8).

5. Lock assembly according to claim 4, characterized in that the safety means includes a safety casing (8.1) surrounding the lock cylinder (8) and showing an end wall with an aperture (8.5) at the key hole in the lock cylinder (8).

6. Lock assembly according to claim 5, characterized in that the safety casing (8.1) is blocked up against removal by means of a first stop screw (8.3) which is screwed into a cylindric groove (8.2) in the safety casing (8.1) from inside of the second locking means (2).

7. Lock assembly according to claim 6, characterized in that the lock cylinder (8) is blocked up against turning by means of a second stop screw (8.4) screwed to the lock cylinder (8) from inside of the second locking means (2).

8. Lock assembly according to claim 4, wherein the safety means include a safety washer arranged inside a safety casing (8.1) between the lock cylinder (8) and the inside of an end wall of the safety casing (8.1).

9. Lock assembly according to claim 1, wherein the second locking means (2) fully surrounds the portions of the first locking means (1) in an outer cavity (5.1) surrounded by walls (5.2) along the sides of the second locking means (2).

10. Lock assembly according to claim 1, wherein the second locking means (2) is connected to the two parts of the first locking means (1) also by another stopping rim (21) arranged on a projecting portion of each part of the first locking means (1) and brought into a corresponding groove (22) in the second locking means (2).

* * * * *